United States Patent [19]

Villamagna et al.

[11] Patent Number: 4,589,331

[45] Date of Patent: May 20, 1986

[54] HIGH BLOWER UNIT FOR AIR DISTRIBUTION SYSTEM

[76] Inventors: Andrew C. Villamagna, 12 Colton Crescent North, Woodbridge, Ontario, Canada, L4L 3L6; Michelle Simone, 159 Firglen Ridge, Woodbridge, Ontario, Canada, L4L 1N3

[21] Appl. No.: 626,885

[22] Filed: Jul. 2, 1984

[51] Int. Cl.[4] ..... F24F 7/06

[52] U.S. Cl. ..... 98/39.1; 98/101; 98/103

[58] Field of Search ..... 98/39, 40 R, 40 C, 101, 98/103, 108, 114

[56] References Cited

U.S. PATENT DOCUMENTS

| | | | |
|---|---|---|---|
| 1,426,900 | 8/1922 | Neal | 98/39 X |
| 1,743,994 | 1/1930 | Waterbury | 98/101 |
| 2,161,001 | 6/1939 | Bedol | 98/103 |
| 2,265,317 | 12/1941 | Schlirf | 98/39 X |
| 2,972,941 | 2/1961 | Bennett | 98/39 X |
| 3,099,201 | 7/1963 | Gottlieb | 98/101 |
| 3,387,549 | 6/1968 | De Castelet | 98/39 X |
| 3,776,214 | 12/1973 | Coffman | 236/11 X |

*Primary Examiner*—Harold Joyce

*Attorney, Agent, or Firm*—Fetherstonhaugh & Co.

[57] ABSTRACT

An air blower comprising a housing having a through passage for air, a blower and a flow sensing device. The through passage has an inlet end and outlet end. The blower is located in the housing and is operable to draw air into the inlet end of the through passage and to blow air out of the outlet end of the through passage. A blower activator is provided which is operable to detect a flow of air into the through passage. The blower activator communicates with the blower to activate the blower when a predetermined air flow into the through passage is detected and to deactivate the blower when less than the predetermined air flow is detected.

10 Claims, 6 Drawing Figures

HIGH BLOWER UNIT FOR AIR DISTRIBUTION SYSTEM

This invention relates to air blowers. In particular, this invention relates to an air blower suitable for use in supplementing the air flow from a particular outlet of an air distribution system.

PRIOR ART

Air distribution systems such as forced air heating systems of houses are difficult to control to ensure that an adequate air supply is discharged from each outlet. Many homeowners are familiar with the difficulties which are experienced in attempting to adequately heat or adequately cool one or more rooms of a house.

In many heating systems, it is common practice to install supplemental heaters in rooms which are difficult to heat. This practice is commonly adopted despite the fact that the central heating unit is quite capable of delivering a sufficient amount of heat to heat the entire house, the difficulty lying the effectiveness of the air distribution system.

Register fans have previously been proposed as for example in U.S. Pat. No. 1,875,683, however, these fans are merely switched on or off by the occupant of the room as required in use.

Supplementary blower units for wall heaters have also been proposed as described in U.S. Pat. No. 4,212,233. In this unit, as in a number of other fan accessory heater systems the blower is activated when the heater temperature reaches a predetermined level and the blower simply serves to more rapidly disperse the heat which is generated by the heater.

A temperature sensitive device is not, however, suitable for use at the outlet registers of an air distribution system of a house or the like because it is the failure of the system to provide an adequately hot or cool temperature at the discharge which contributes to the failure of the air distribution system. That is to say a room is unduly cold because the air which is being discharged into the room is inadequate in volume and is not sufficiently warm. Thus, if the blower is only activated when the outlet is heated by the incoming air, there is likely to be a considerable delay in activating the blower and this would defeat the object of the device of the present invention.

We have found that by providing an air blower which is activated when the air distribution system as a whole is activated to create a predetermined minimum rate of air flow it is possible to ensure that the air blower is activated as soon as the air distribution system becomes active.

SUMMARY OF INVENTION

According to one aspect of the present invention, an air blower assembly comprises, a housing having a through passage for air, said passage having an inlet end and outlet end, a blower in said housing which is operable to draw air into said inlet end of said through passage and to blow air out of said outlet end of said through passage, blower activator means communicating with said blower and operable to activate said blower when a predetermined air flow is directed to the inlet of the housing and to deactivate said blower when less than the predetermined air flow is detected.

According to yet another aspect of the present invention an air blower for use in association with an air distribution system of a building or the like for the purpose of increasing the rate at which an air current is discharged from a discharge output of the air distribution system comprises, a housing having a chamber formed therein, an inlet and an outlet communicating with the chamber and cooperating therewith to form a through passage, a fan mounted in said chamber and arranged to increase the rate of flow of air through said passage when in use, switch means communicating with said fan for activating and deactivating said fan, flow sensing means arranged to extend into the path of said air current, said flow sensing means being operable to locate said switch in a position activating said fan when a predetermined air flow is sensed and to locate said switch in a position deactivating said fan when the air flow rate falls below said predetermined air flow rate.

According to yet another aspect of the present invention there is provided in an air distribution system in which air is periodically distributed at an elevated rate of flow to a plurality of outlets, the improvement of; an air blower at atleast one of said outlets, said air blower comprising; a housing having a through passage for air, said passage having an inlet end and outlet end, a blower in said housing which is operable to draw air into said inlet end of said through passage and to blow air out of said outlet end of said through passage, blower activator means communicating with said blower and operable to activate said blower when a predetermined air flow into said through passage is detected and to deactivate said blower when less than the predetermined air flow is detected.

The invention will be more clearly understood after reference to the following detailed specification read in conjunction with the drawings wherein.

Figure 2:
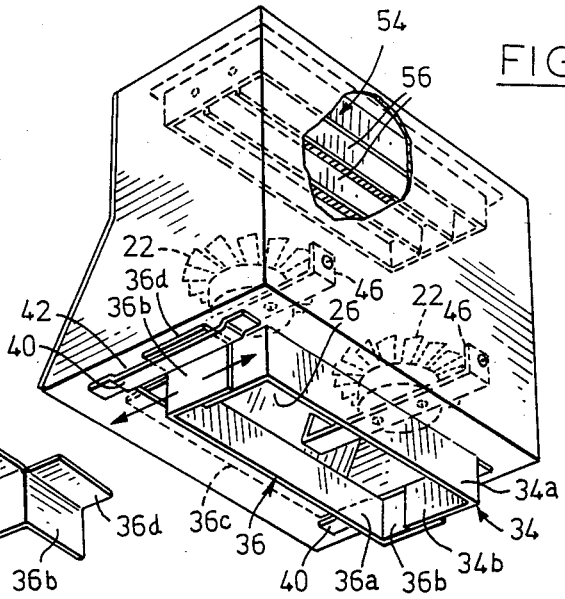
FIG. 2 is a bottom pictorial view of the blower of FIG. 1, in which the sail has been removed for clarity of illustration.
Figure 3:
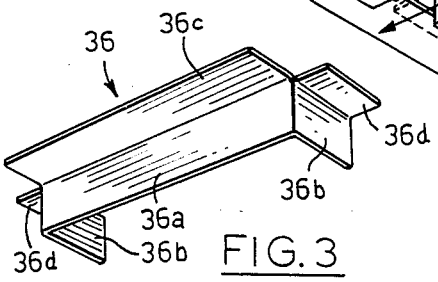
FIG. 3 is a perspective view of the movable part of the inlet duct.

With reference to the drawings, the reference numeral 10 refers generally to the blower assembly constructed in accordance with an embodiment of the present invention. The blower assembly 10 comprises a housing 12, an on/off variable speed control switch 14, a blower activator 16, a first indicator lamp 18, a second indicator lamp 20 and a pair of blowers 22.(FIG. 2).

Figure 4:
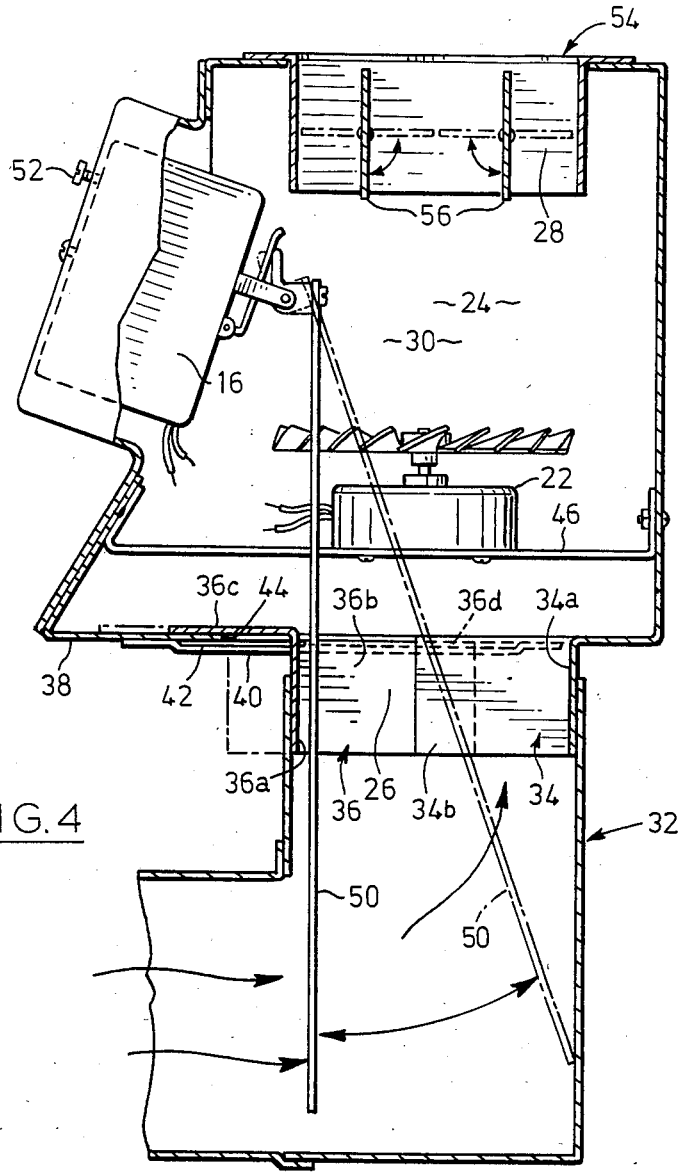
FIG. 4 is a sectional side view taken along the line 4—4 of FIG. 1, with the blower operably located in the duct.

The housing 12 has a chamber 24 (FIG. 4) formed therein. An inlet 26 opens into the chamber 24 and an outlet 28 opens from the chamber 24. The inlet 26, chamber 24 and outlet 28 form a through passage 30 extending through the housing. The housing 12 is constructed so as to be substantially airtight about the through passage 30.

The duct outlets 32 in association with which the blower 10 is to be used may vary in size. Generally there are two standard sizes in common use. To accommodate these two sizes, the inlet 26 is size adjustable.

The inlet 26 has wall portions 34 and 36 (FIG. 2 and 4) of which the wall portion 34 is stationary and the wall portion 36 is slidable. The wall portion 34 comprises a back panel 34*a* and a pair of side panels 34*b* arranged in a generally U-shaped configuration. The wall portion 34 is secured with respect to the housing 12. The wall portion 36 comprises a front panel 36*a*, and a pair of side panels 36*b* which are arranged in a U-shaped configuration. A flange 36*c* projects forwardly from the upper edge of the front panel 36*a* and flanges 36*d* project from opposite side portions 36*b*. The flange 36*c* extends to overlie the adjacent portion of the bottom wall 38 of the housing 12. The flanges 36*d* extend into a slot 42 which is formed between the bottom wall 38 of the housing and rails 40 such that the wall portion 36 can slide from the position shown in solid lines in FIG. 4 to the position shown in broken lines in FIG. 4 to accommodate the variations in the proportions of the outlet duct. Flange 36*c* is proportioned to ensure that the opening 44 which is formed in the bottom wall of the housing 12 is closed outwardly from the inlet 26 in all positions of the moveable wall portion 36.

The blowers 22 are in the form of fans which are each mounted on bridge members 46 and when in operation they serve to draw air into the housing through the inlet 26 and expell air from the housing through the outlet 28. The fans may be of a conventional construction and will not therefore be described in detail.

The blower actuator 15 consists of a sail switch 16 and a sail member 50. The sail switch 16 may be of a conventional sail switch construction and a suitable sail switch is manufactured by Honeywell Limited and identified by Part No. S688A. The sail switch 16 has an actuator arm 48 from which the sail member 50 depends. The sail member 50 has a sufficient length to extend from the actuator arm through the inlet 26 and into the duct outlet 32 in use. The sail switch 16 also has a sensitivity adjustment screw 52 which is accessible from the exterior of the housing 12. The sail switch 16 acts as a flow sensor which responds to the air flow to activate the fans 22 when a predetermined air flow is detected.

A conventional air outlet register 54 is mounted in the air outlet 28 and has adjustable doors 56 which may be moved to any required position to control the flow of air from the outlet 28.

The primary flow control adjustment is provided by means of the on/off variable speed control switch 14. This switch 14 may be a conventional "dimmer switch". The switch 14 has an off position and a variable on position.

To permit the blower device to be fully portable a power input line 60 is provided which has a conventional plug 62 which will permit the unit to be plugged into a conventional room outlet.

Figure 5:
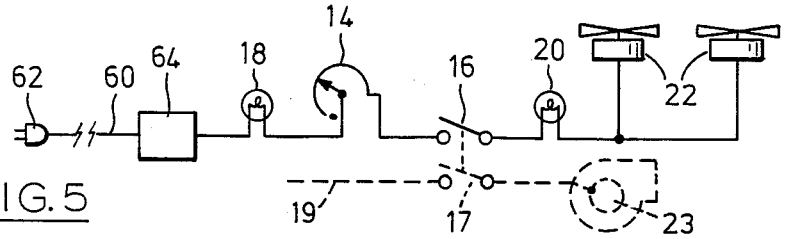
FIG. 5 is a diagram illustrating the electrical circuit.

As shown in FIG. 5 of the drawings, the electrical power is supplied through the plug 62 and supply line 60 to junction box 64 which is located within the housing 12. The first indicator lamp 18 will be illuminated as soon as the plug 62 is operably positioned in an outlet to provide an indication that the unit is powered. When the blower is not in use, the switch 14 will be located in the off position thereby interrupting supply of power to the fans 22. When the switch 14 is in the on position, power is transmitted to the sail switch 16. When the sail switch 16 is open the supply of power to the flange 22 is interrupted. When the sail switch 16 is closed power is supplied to the fans 22 and the second indicator lamp 20 is illuminated to provide a signal indicating that the fans 22 are in operation. The speed of the fans 22 can be adjusted as required by adjusting the position of the variable speed control switch 14.

Figure 1:
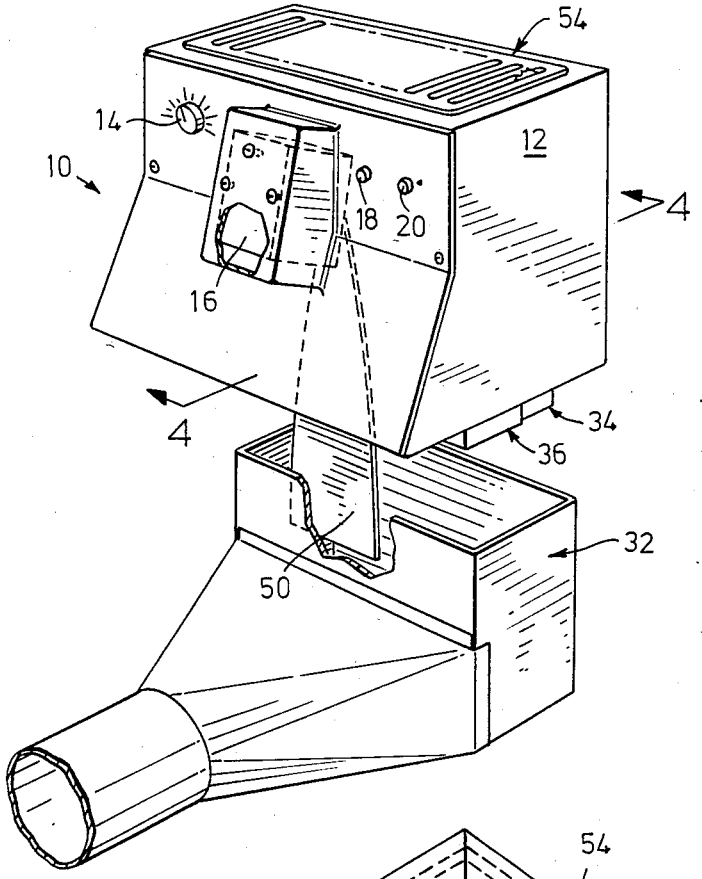
FIG. 1 is a pictorial view of an air blower constructed in accordance with an embodiment of the present invention illustrating the positioning of the blower with respect to an outlet duct of an air distribution system.

In use, when a cold spot of an air distribution system has been identified, the blower assembly of FIG. 1 is positioned so as to communicate with the outlet duct at the cold spot and the plug 62 is plugged into a convenient room outlet. The sail 50 is positioned so as to extend into the outlet so that it lies in the air stream which will pass from the outlet 32 through the through passage 30. The sensitivity screw 52 is adjusted to ensure that the sail switch is in the off position when the hot air supply to the outlet 32 is inactive. In an air distribution system wherein the main supply fan which supplies hot air from the furnace is an on/off fan, the sensitivity of the sail switch 16 is adjusted so that the sail switch 16 will be open when no air flows through the duct 32 and will close immediately when the first indication of air flow reaches the outlet duct 32. When a two speed fan is used in the air distribution system, the sensitivity of the sail switch 16 may be adjusted to ensure that the sail switch 16 is open when the main fan is operating at the lower speed and closes when the fan operates at the higher speed. Thus it will be seen that as soon as an air flow is detected in the outlet duct 32 which is in excess of a predetermined amount, the sail member 50 will be deflected to a sufficient extent to close the sail switch 16 thereby to activate the fans 22. When the main fan is deactivated, the drop in the air flow through the duct 32 will permit the sail member 50 to return to the inactive position opening the sail switch 16 and thereby deactivating the fans 22.

It is well known that the flow in most air distribution systems originates with a primary fan or blower as in the case of the warm air distribution system of many domestic installations. It follows that the flow sensor device may be replaced by a secondary blower activator which activates the fans 22 or 82 when the primary blower is activated. This can be achieved in the manner illustrated in broken lines in FIG. 5 by connecting the switch 17, which is located in the powered line 19 which supplies power to the primary blower 23, to the switch 16. In this manner as soon as the switch 17 is closed, the switch 16 will be closed with the result that as soon as the primary blower 23 is activated the secondary blowers 22 will be activated and as soon as the primary blower 23 is deactivated, the secondary blowers 22 will be deactivated. Various alternative switching systems may be provided to achieve the same desired effect.

From the foregoing, it will be apparent that the blower assembly will serve to draw a greater amount of air to the outlet duct 32 at which it is mounted and by manually adjusting the speed control switch 14, it is possible to obtain the required volume of discharge at the outlet 28. It will therefore be apparent that the blower described above may be used for the purposes of supplying additional hot air to a cold spot or supplying additional cool air to a hot spot in an air circulating system of a building or the like.

It will be further apparent that the blower described above is activated and deactivated in response to changes in the rate of flow of air with the flow control device being sufficiently sensitive to ensure that the fans will be activated immediately upon detection of an increase in air flow in the duct leading to the blower regardless of the temperature of the air passing through the duct. It follows that the start-up of the blower motors is not delayed by any need to detect a temperature increase and consequently the blower is immediately effective to increase the flow of air to the outlet at which it is mounted in use.

Figure 6:
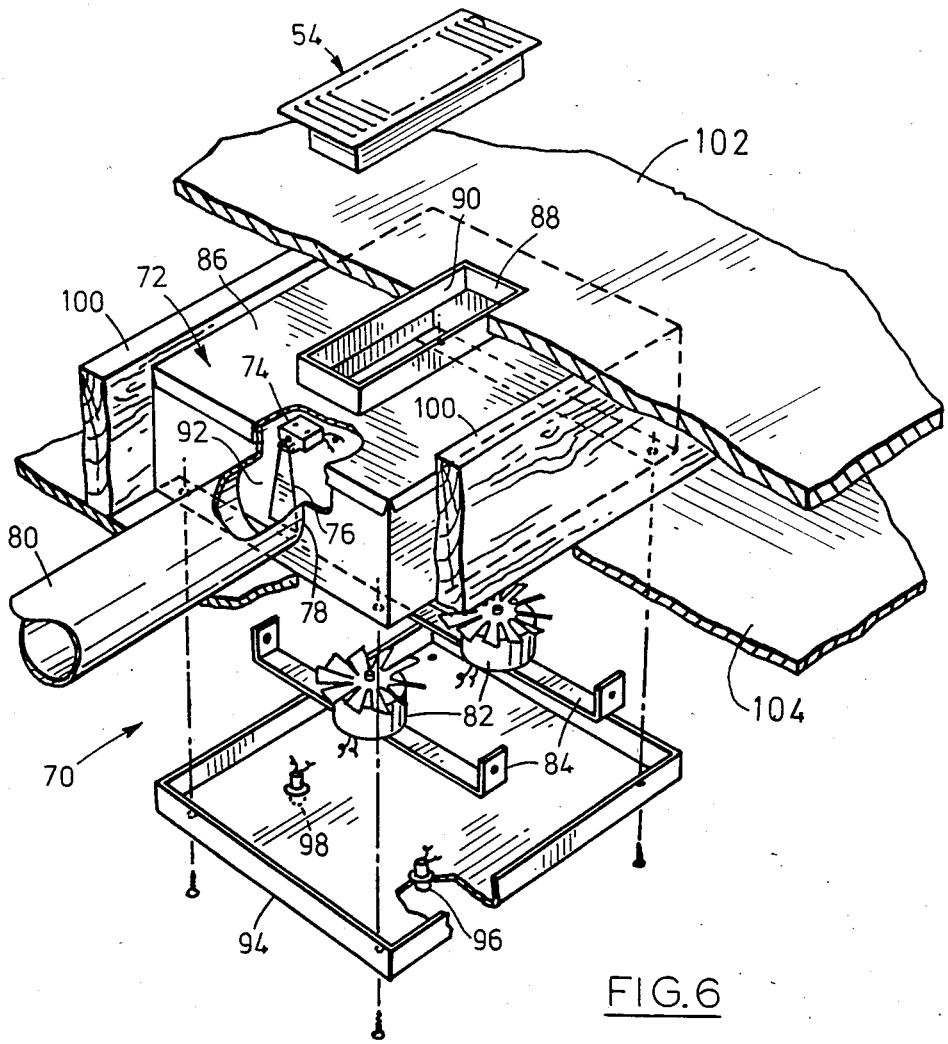
FIG. 6 is a partially exploded and partially sectioned pictorial view of an air blower according to another embodiment of the present invention.

A modified air blower generally identified by the reference numeral 70 is illustrated in FIG. 6 of the drawings. In this embodiment, the reference numeral 72 refers generally to a housing in which a sail switch 74 is mounted so that the sail 76 extends across the output end 78 of the conduit 80. A pair of fans 82 are mounted on bridges 84 which are secured within the housing 72.

The housing 72 has a top wall 86 through which an outlet 88 opens. A collar 90 surrounds the outlet 88 and projects upwardly from the top wall 86. The inlet 92 is aligned with the output 78 of the conduit 80. A removable bottom wall panel 94 is mounted on the underside of the housing 72 and first and second indicator lights 96 and 98 are mounted on the bottom wall panel 94 so as to be invisible from the underside thereof.

The blower constructed in accordance with the embodiments ilustrated in FIG. 6 of the drawings is suitable for use in an installation in which it is prefitted into the air distribution system such that a blower of this construction may be located at the outlet of each branch of the air distribution system or at the outlets which are the most remote from the heat source.

The blower of FIG. 6 is particularly suitable for use between floors of a building and may be located between the joists 100 so that the outlet 88 opens upwardly through the floorboards 102 of the upper floor and the bottom closure plate 94 is removable downwardly through an opening in the ceiling 104 of the lower floor. In this embodiment, the housing 72 is rigidly secured to the joists 100 by any suitable mounting means and access for servicing is by way of the removable lower wall panel 94. The indicator lights 96 and 98 are mounted in the removable bottom wall panel 94 so as to be visible from the room below that into which the air is discharged in use. The blower assembly of FIG. 6 operates in a like manner to that previously described with respect to FIGS. 1 to 4 in that the sail switch 74 is activated when the incoming air impinges against the sail 76 and the switch 74 in turn activates the blowers 82. A speed control such as the speed control switch 14 (FIG. 1) may be located at any convenient location within the room into which air is being directed.

Various modifications of the structure described above will be apparent to those skilled in the art without departing from the scope of the invention. It will for example be apparent that a single fan may be employed in the blower rather than the two fans illustrated in the preferred embodiment. It will also be apparent that a thermostatically operated switch may also be provided in the electrical circuit to ensure that if the space which is to be heated is heated above a predetermined temperature or the space which is to be cooled is cooled below a predetermined temperature, the fans may be deactivated. It will also be apparent that flow sensing switches of the type other than the sail switch described above may be employed with equal effect. The sail switch has the advantage of being extremely sensitive to low velocity air flow in large ducts and is therefore one preferred form of flow control device. In some instalations the sail switch may be found to be too sensitive in which case an alternative form of flow control device such as that illustrated in broken lines in FIG. 5 may be employed. These and other modifications will be apparent to those skilled in the art.

We claim:

1. An air blower assembly for use in an air distribution system in which air is periodically distributed at an elevated rate of flow to a plurality of outlets, comprising;

(a) a housing having a through passage for air, said passage having an inlet end and outlet end, (b) a blower in said housing which is operable to draw air into said inlet end of said through passage and to blow air out of said outlet end of said through passage, (c) a flow sensing means arranged to detect the presence or absence of a predetermined air flow into said housing, (d) blower activator means communicating with said blower and said flow sensing means and operable to activate said blower when said predetermined air flow is detected by said flow sensing means and to deactivate said blower when less than the predetermined air flow is detected.

2. An air blower assembly as claimed in claim 1, wherein said flow sensing means is adjustable so as to adjust the predetermined air flow required to activate and deactivate said blower.

3. An air blower assembly as claimed in claim 1, further comprising first indicator means operable to provide a signal which is indicative of the fact that the air blower assembly is connected to a source of electrical energy.

4. An air blower assembly as claimed in claim 3, further comprising second indicator means which is operabile to provide a signal which a indicative that the blower is in operation.

5. An air blower assembly as claimed in claim 1, wherein said blower comprises a pair of electrically driven fans.

6. An air blower assembly as claimed in claim 1 wherein said flow sensing means comprises a sail switch which comprises an electrical switch and a sail element, said sail element being located so as to operable in response to said predetermined air flow to activate and deactivate said electrical switch as required in use.

7. An air blower for use in association with an air distribution system of a building or the like for the purpose of increasing the rate at which an air current is discharged from a discharge output of the air distribution system comprising;

(a) a housing having a chamber formed therein, an inlet and an outlet communicating with the chamber and cooperating therewith to form a through passage, (b) a fan mounted in said chamber and arranged to increase the rate of flow of air through said passage when in use, (c) switch means communicating with said fan for activating and deactivating said fan, (d) flow sensing means arranged to extend into the path of said air current, said flow sensing means being operable to locate said switch in a position activating said fan when a predetermined air flow is sensed and to locate said switch in a position deactivating said fan when the air flow rate falls below said predetermined air flow rate.

8. An air blower assembly as claimed in claim 7, wherein said flow sensing means is adjustable so as to adjust the predetermined air flow required to activate and deactivate said blower.

9. An air blower assembly as claimed in claim 7, further comprising first indicator means operable to provide a signal which is indicative of the fact that the air blower assembly is connected to a source of electrical energy.

10. An air blower assembly as claimed in claim 9, further comprising second indicator means which is operable to provide a signal which is indicative that the blower is in operation.

* * * * *